US010138103B2

(12) United States Patent
Liu

(10) Patent No.: US 10,138,103 B2
(45) Date of Patent: Nov. 27, 2018

(54) ELECTRIC WINE OPENER

(71) Applicant: YONGXIN STATIONERY (SHENZHEN) CO., LTD., Shenzhen (CN)

(72) Inventor: Yingming Liu, Shenzhen (CN)

(73) Assignee: Yongxin Stationery (Shenzhen) Co., Ltd., Shenzhen, Guangdong (CN)

( * ) Notice: Subject to any disclaimer, the term of this patent is extended or adjusted under 35 U.S.C. 154(b) by 153 days.

(21) Appl. No.: 15/328,855

(22) PCT Filed: Feb. 2, 2016

(86) PCT No.: PCT/CN2016/073213

§ 371 (c)(1),
(2) Date: Jan. 24, 2017

(87) PCT Pub. No.: WO2017/132838

PCT Pub. Date: Aug. 10, 2017

(65) Prior Publication Data

US 2018/0050895 A1 Feb. 22, 2018

(51) Int. Cl.
*B67B 7/04* (2006.01)

(52) U.S. Cl.
CPC .... *B67B 7/0405* (2013.01); *B67B 2007/0458* (2013.01)

(58) Field of Classification Search
CPC ..... B67B 7/0405; B67B 7/04; B67B 7/44; B67B 2007/0458
See application file for complete search history.

(56) References Cited

U.S. PATENT DOCUMENTS 5,095,778 A * 3/1992 Bocsi ..... B67B 7/0405 81/3.2
6,321,620 B1 * 11/2001 Fabbro ..... B67B 7/0405 81/3.09

(Continued)

FOREIGN PATENT DOCUMENTS

CA 2255986 A1 7/1999
CN 2841622 Y 11/2006

(Continued)

*Primary Examiner* — David B Thomas
(74) *Attorney, Agent, or Firm* — Ladas & Parry, LLP

(57) ABSTRACT

The present disclosure discloses an electric wine opener. It includes a bracket and a driving device which comprises a rotating shaft with a polygonal cross-section and a motor. The rotating shaft is rotatably installed on the bracket. The motor is installed on the bracket. The input shaft of the motor is connected to the rotating shaft. The electric wine opener further comprises a cylindrical cork extraction device which comprises a sleeve, a screw, a threaded drill, a cork sleeve, the sleeve with internal thread in the middle is mounted in the bracket. The screw is provided with a hexagonal hole corresponding to the rotating shaft. The screw is fitted in the rotating shaft. The electric wine opener further comprises a clamping device. Because the driving device, cork extraction device and clamping device are provided in the bracket, the driving device can drive the clamping device to clamp the bottle and the cork extraction device to extract the cork so as to ensure the electric wine opener to clamp the bottleneck of the wine bottle and further extract the cork automatically. The electric wine opener is easy to operate and it can be used to extract the cork steadily and quickly.

10 Claims, 8 Drawing Sheets

(56) References Cited

U.S. PATENT DOCUMENTS

| | | | | |
|---|---|---|---|---|
| 8,578,819 | B2 * | 11/2013 | Cheung | B67B 7/0405 81/3.2 |
| 9,688,522 | B2 * | 6/2017 | Song | B67B 7/0405 |
| 2007/0107555 | A1 | 5/2007 | Zhou | |
| 2013/0112044 | A1 | 5/2013 | Lawlor et al. | |

FOREIGN PATENT DOCUMENTS

| | | | |
|---|---|---|---|
| CN | 2868979 | Y | 2/2007 |
| CN | 201686466 | U | 12/2010 |
| CN | 103086305 | A | 5/2013 |
| EP | 0930265 | A1 | 7/1999 |
| EP | 1215165 | A1 | 6/2002 |
| EP | 1902999 | A1 | 3/2008 |

* cited by examiner

ELECTRIC WINE OPENER

CROSS-REFERENCE TO RELATED APPLICATION

The present application is the U.S. national phase of PCT Application PCT/CN2016/073213 filed on Feb. 2, 2016, and entitled "ELECTRIC WINE OPENER", the disclosure of which is incorporated herein by reference in its entirety.

TECHNICAL FIELD

The present disclosure relates to a wine opener, in particular to an electric wine opener.

BACKGROUND ART

At present, an electric wine opener can only be used to extract a cork from a wine bottle, failing to electrically cutting off sealing film on the wine bottle. An additional tool is needed to cut off the sealing film on the bottle manually.

Furthermore, during pulling out the cork, process thereof is comparative low in automation level, needing to hold the bottle and the wine opener with two hands respectively so as to restrain rotation of the wine opener relative to the bottle caused by the process. Meanwhile, in order to keep a motor of the opener energized to complete pulling out the cork electrically, the hand holding the opener needs to press a switch button on the opener to be triggered continuously; therefore the opener is inconvenient to be operated.

SUMMARY OF THE INVENTION

The present disclosure provides a fully automatic and effective electric wine opener.

In one embodiment, an electric wine opener provided comprises:

a bracket with a cylindrical structure, both ends of the bracket being provided with an opening, a sidewall of the bracket being provided with first evading apertures symmetrically arranged in the middle, and one end of the sidewall being provided with second evading apertures arranged symmetrically;

a drive device comprising a rotating shaft and a motor, the rotating shaft being provided with a polygonal cross-section, the shaft being rotatably installed on the bracket, the motor being installed on the bracket, and an output shaft of the motor being connected to the rotating shaft;

a cork extraction device comprises a sleeve, a screw, a threaded drill, a cork sleeve and a block, the sleeve with an internal thread at the middle being embedded in the bracket, the screw provided with a polygonal through-hole corresponding to the rotating shaft being fitted on the rotating shaft, the threaded drill accommodated in the bracket being fixed on one end of the screw, a first spring being arranged between the rotating shaft and the threaded drill in a state of compression, one end of the screw away from the threaded drill being provided with an external thread matched with the sleeve, the cork sleeve with two symmetrical mounting lugs being installed in the bracket, the mounting lugs projecting from the second evading apertures of the bracket, one end of the cork sleeve close to the screw being provided with an annular counterbore, the block being movably installed on the counterbore, a second spring being arranged between the block and the bracket in a state of compression, a through-hole being provided in the middle of the block for avoiding the threaded drill, the sleeve and the cork sleeve being disposed on both ends of the bracket respectively, and the inner wall of the cork sleeve being provided with an axial rib; and a clamping device comprising a first lever and a second lever, the first lever and second lever being symmetrically and rotatably installed on the mounting lugs of the cork sleeve, the same ends of the first lever and the second lever being respectively provided with blocking plates opposed to each other, the blocking plates being inserted in the first evading apertures of the bracket, the blocking plate being in contact with the screw via a sloping surface, and the other ends of the first lever and the second lever being respectively provided with curved anti-slip covers opposed to each other.

Further, the electric wine opener may further comprise an automatic control device including a start slider, a start switch, a reversal switch, a stop slider, a stop switch and a controller.

The start slider, which is of an annular structure, is installed on an open end of the cork sleeve via a spring, the start switch is installed on the bracket, the start switch is arranged close to the start slider, so that the start slider can be in contact with a contactor of the start switch to trigger the start switch after the start slider is slid to the cork sleeve;

the reversal switch is installed on the bracket, the reversal switch is arranged close to the block, so that the block can be in contact with the contractor of reversal switch to trigger the reversal switch after the block slides to the screw;

the stop slider is movably installed on the bracket via a spring, one end of the screw close to the threaded drill is provided with an annular bulge, the stop slider is in contact with the bulge of the screw by moving through the bracket, the stop switch is installed on the bracket and arranged to the stop slider, so that the stop slider can be in contact with the stop switch to trigger the stop switch after the stop slider is separated from the bulge of the screw;

the start switch, the reversal switch and the stop switch are connected to the controller respectively, and the controller is electrically coupled to the motor.

Further, the driving device may further comprise a reducer and a gear train, the reducer is installed on the bracket, the output shaft of the motor is connected to the reducer, and the rotating shaft is connected to an output shaft of the reducer via the gear train.

Further, the mounting lug of cork sleeve is provided with a slot, the first lever and second lever are rotatably installed on the slot via a hinge pin, elastic rubber is filled between the slot and the hinge pin.

Further, elastic soft rubber with a cone-shaped inner hole is embedded in an inner hole of the start slider.

Further, one end of the bracket away from the motor is provided with two auxiliary righting plates disposed between the first lever and the second lever.

In another embodiment, the electric wine opener may further comprise a film cutting device comprising a rotating frame, a blade carrier, a torsion spring and a blade. The rotating frame is fixed on an end of the rotating shaft extending out the bracket. The rotating frame is provided with an open cavity used for accommodating a bottleneck. A sidewall of the open cavity is provided with a slot. One end of the blade carrier is rotatably installed on the slot of the rotating frame, and the other end of the blade carrier extends into the open cavity of the rotating frame. The torsion spring is installed between the blade carrier and the rotating frame, one end of the torsion spring is in contact with the blade carrier, and the other end of torsion spring is in contact with the rotating frame. The blade is installed on one end of the blade barrier positioned on the slot. When one end of the blade is axially moved to the rotating shaft, the other end of the blade is raised; thus causing part of the blade extends into the open cavity of the rotating frame.

Further, the electric wine opener may further comprise a cutting slider and a cutting switch. The cutting slider is movably installed on the bracket. The cutting switch is installed on the bracket and arranged close to the cutting slider, and the cutting switch is electrically connected with the controller.

Further, the electric wine opener may further comprise a balancing slider covered on the three blade carriers and axially and movably installed on the rotating frame.

Further, a surface of the rotating frame opposed to the bracket is inlaid with three spring pins, and the three spring pins are uniformly distributed in a circle.

For the electric wine opener according to the aforementioned embodiment, by means of providing the bracket with the driving device, the cork extraction device and the clamping device, and the driving device driving the clamping device to clamp the bottle and the cork extraction device to extract the cork, the electric wine opener can clamp the bottleneck of the wine bottle automatically and extract the cork automatically. The electric wine opener is easy to be operated, extracting the cork steadily and quickly.

DETAILED DESCRIPTION

The present disclosure will be further illustrated in the following embodiments with the accompanying drawings.

First Embodiment

An electric wine opener is provided in this embodiment. Though the wine opener is used to extract a cork or a stopper of a wine bottle to decap, it can also be used for other kinds of bottles with corks.

Figure 1:
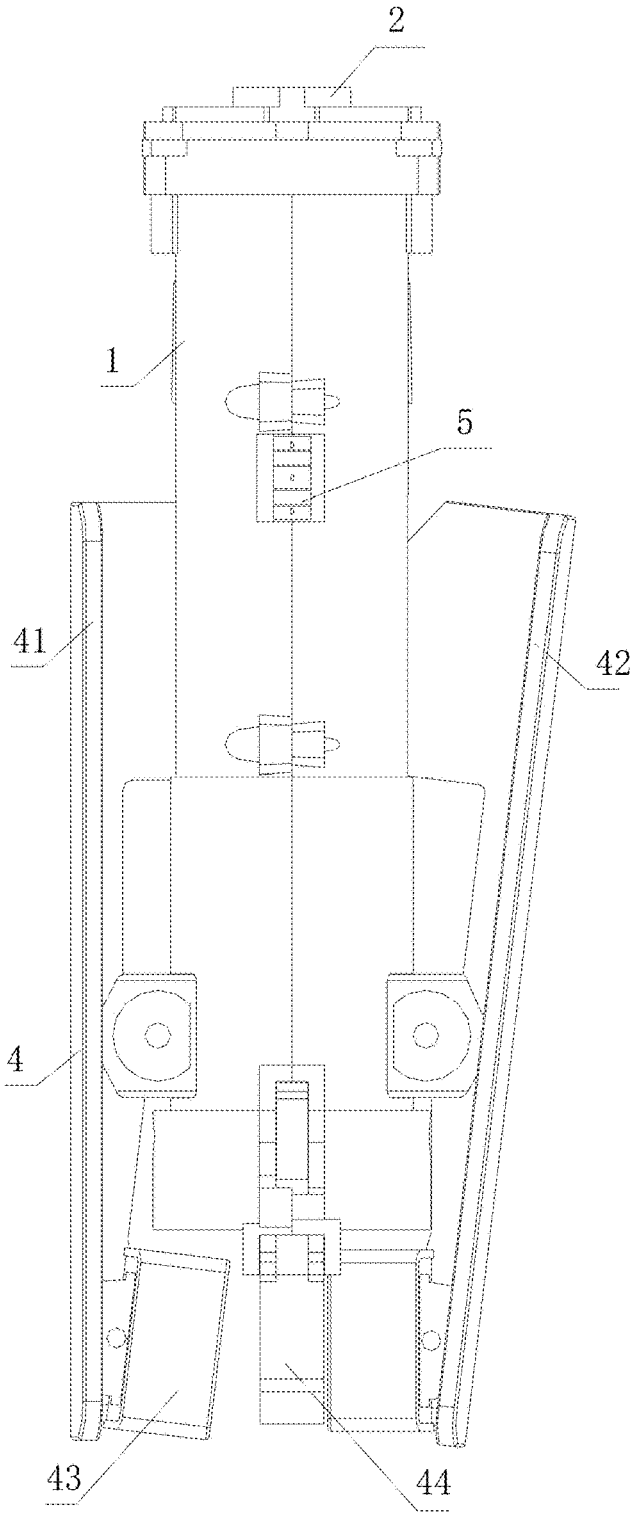
FIG. 1 is a front view of the electric wine opener in an embodiment.
Figure 2:
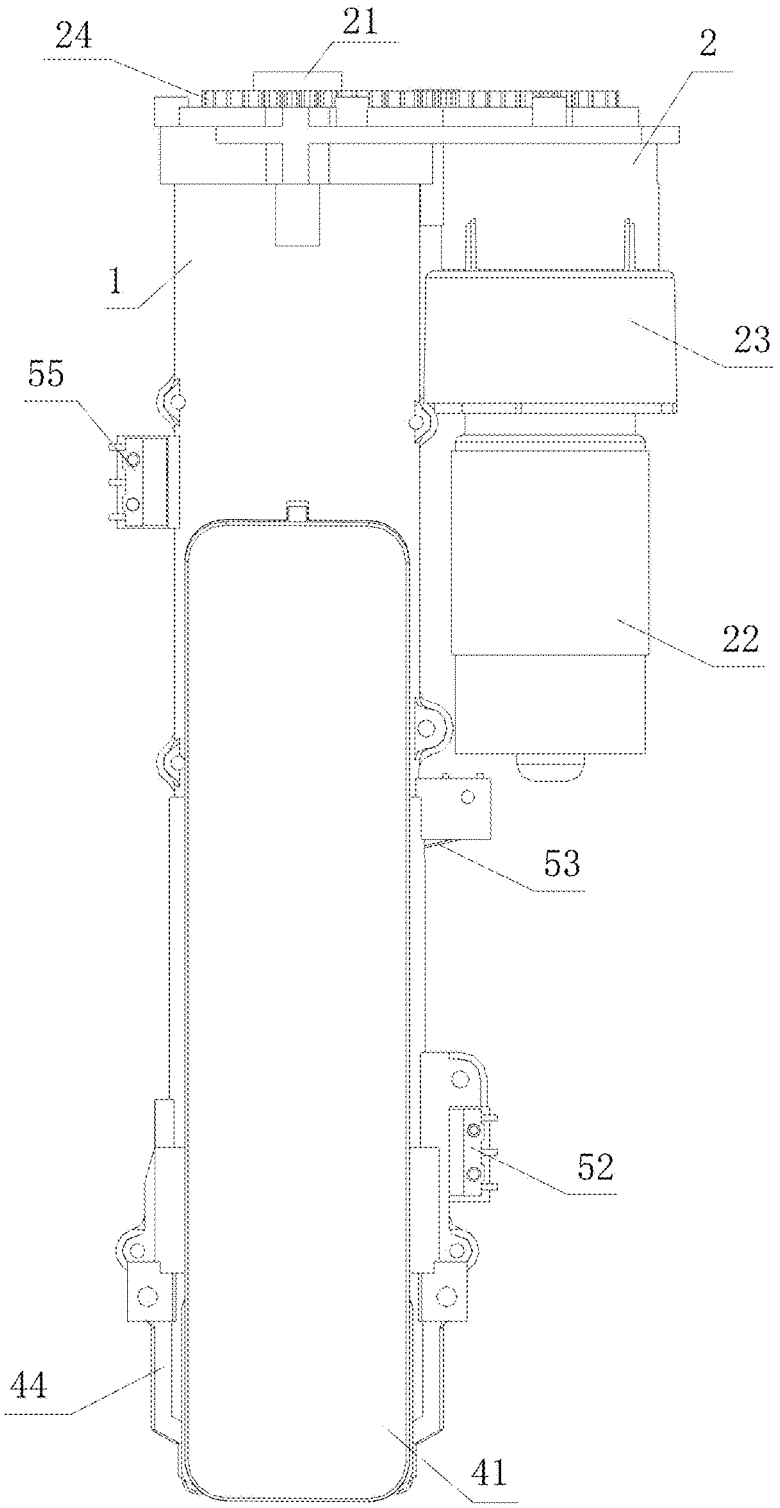
FIG. 2 is a side view of the electric wine opener in an embodiment.

As shown in FIGS. 1-2, the electric wine opener comprises a bracket 1, a driving device 2, a cork extraction device 3 and a clamping device. The driving device 2, the cork extraction device 3 and the clamping device 4 are installed on the bracket 1. The driving device 2 is connected to the cork extraction device 3 so as to drive the cork extraction device to extract the cork. The clamping device 4 is connected to the cork extraction device 3, and the clamping device 4 can be driven by the cork extraction device 3 to clamp the bottle before pulling out the cork. A specific structure of the electric wine opener is shown below.

The bracket 1 is composed of two symmetrical shells. The two shells are enclosed to form a cylindrical structure. A cavity is provided in the middle of the bracket 1 and two openings are provided in both ends of the bracket 1 respectively. There are first evading apertures symmetrically arranged in the middle of the sidewall of the bracket 1, and second evading apertures arranged symmetrically at the bottom of the sidewall.

Figure 3:
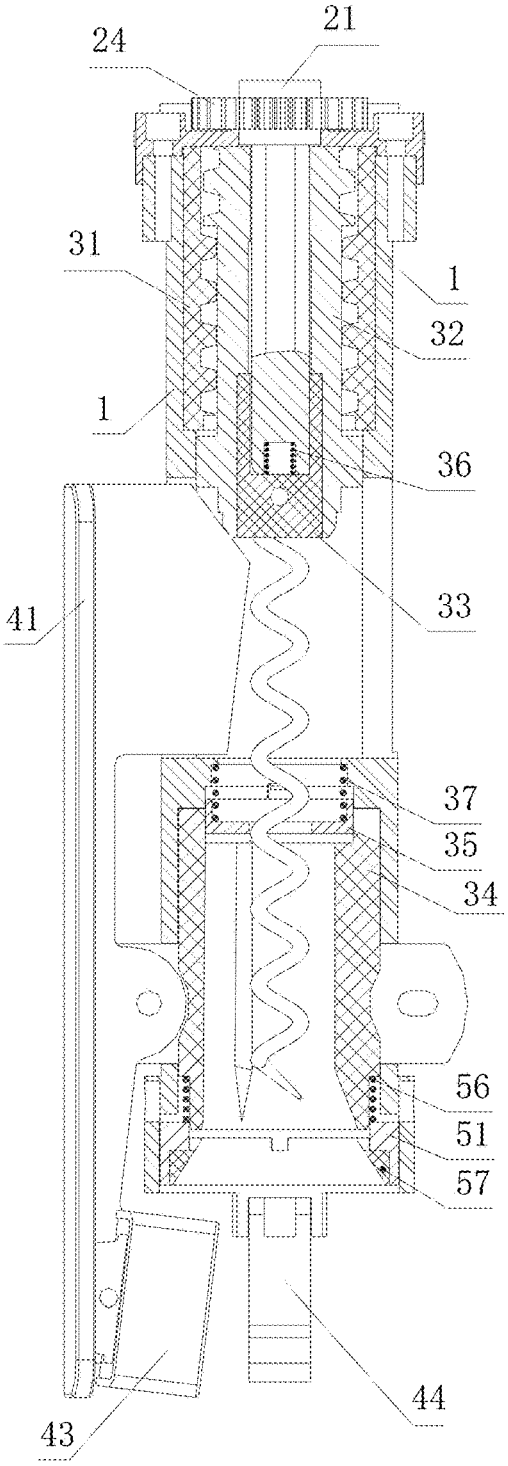
FIG. 3 is a front section view of the electric wine opener in an embodiment.
Figure 4:
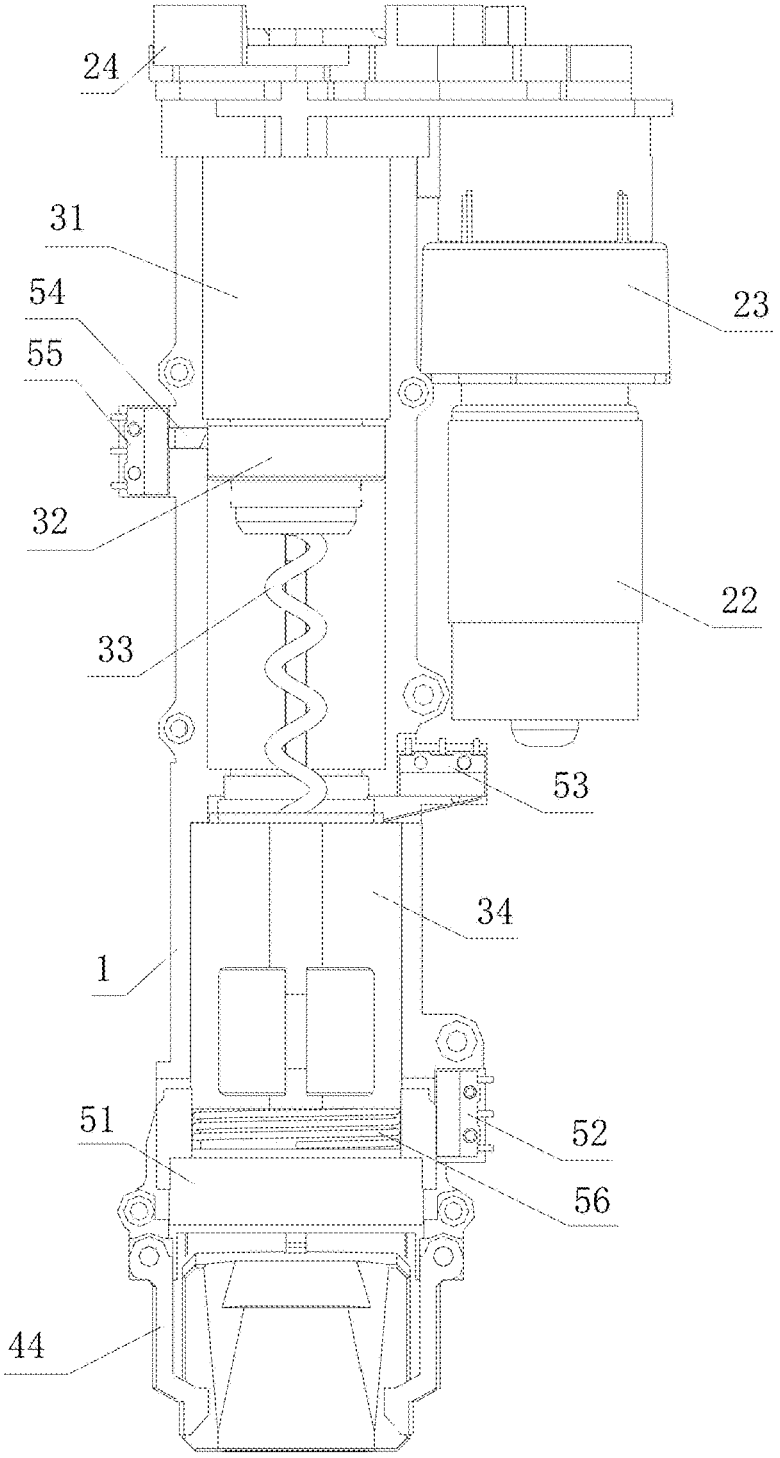
FIG. 4 is a side section view of the electric wine opener in an embodiment.

As shown in FIGS. 3-4, the driving device 2 comprises a rotating shaft 21, a motor 22, a reducer 23 and a gear chain 24. The rotating shaft 21 is a hexagonal shaft, that is, the cross-section of the rotating shaft 21 is a hexagon. In other embodiments, the rotating shaft 21 can also be a triangular shaft, a square shaft or a polygonal rotating shaft. The motor 22 and the reducer 23 are installed on the sidewall of the bracket 1. An output shaft of the motor 22 is connected to the reducer 23. The gear chain 24 comprises three gears, among which one provided with a hexagonal hole in the middle is rotatably installed on the upper end of the bracket 1 and is fitted with the rotating shaft; another one is installed on the reducer 23 whose output shaft is connected to the gear; and the last one, rotatably installed on the bracket 1, is installed between the first two gears and engaged with the two former gears respectively so as to ensure the three gears to form a reducer connection. The motor 22 drives the rotating shaft 21 to rotate by connecting with the reducer 23 and the gear chain 24. The rotating shaft 21 is accommodated in the cavity of the bracket 1. The gear chain 24 is also provided with an upper gearbox and a lower gearbox to packaging the gear chain 24.

Figure 5:
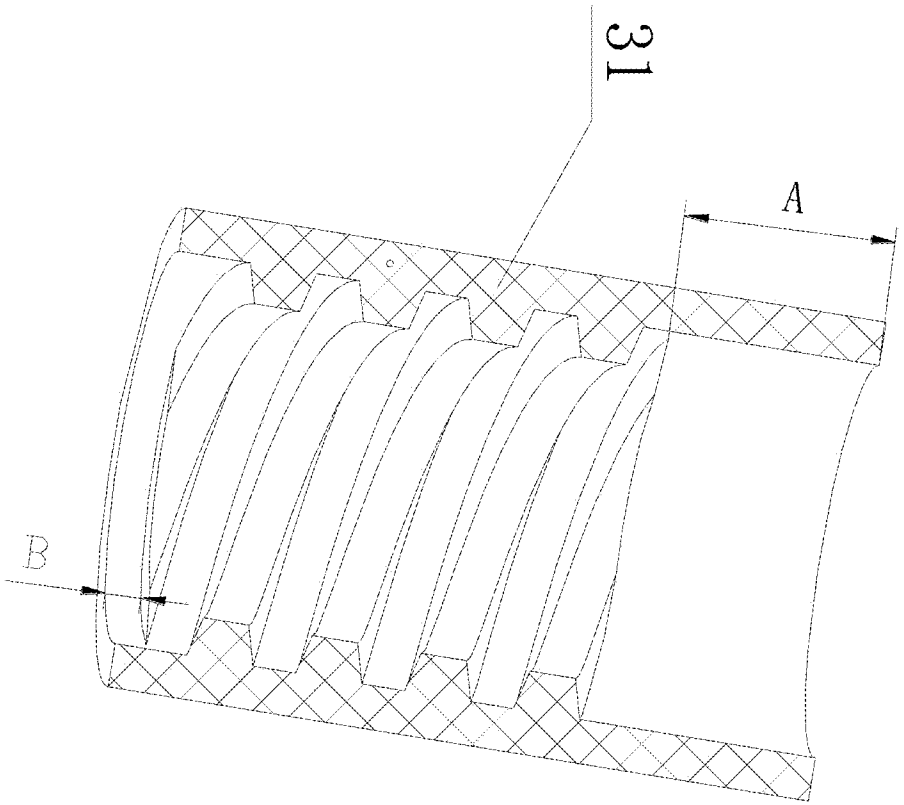
FIG. 5 is a section view of a sleeve of the electric wine opener in another embodiment.

The cork extraction device 3 mainly comprises a sleeve 31, a screw 32, a threaded drill 33, a cork sleeve 34 and a block 35. The sleeve 31 is embedded in the upper end of the bracket 1. The middle portion of the inner wall of the sleeve 31 is provided with internal thread, while no threads are provided in the upper end and the lower end of the sleeve. As shown in FIG. 5, no threads are provided in segment A and segment B at both ends of the sleeve 31. The screw 32 is provided with a hexagonal threaded hole. The screw 32 is fitted on the rotating shaft 21. The rotating shaft 21 is connected to the screw 32 via the hexagonal hole, so that the rotating shaft 21 can drive the screw 32 to rotate, and the screw 32 can move axially respect to the rotating shaft 21. The upper end of screw is provided with an external thread, and the external thread of the screw 32 is matched with the internal thread of the sleeve 31. The upper end of the threaded drill 33 is provided with a hexagonal mounting head. The hexagonal mounting head is installed in the hexagonal hole of the lower end of the screw 32, blocking the hexagonal hole. The threaded drill 33 is accommodated in the cavity of the bracket. The threaded drill 33 is aligned with the rotating center of the rotating shaft 21. The lower end of the rotating shaft 21 is provided with a slot. The slot is provided with a first spring 36 installed between the rotating shaft 21 and the threaded drill 33. The first spring 36 is in a compressed state, offering the screw 32 a downward axial force.

The cork sleeve 34 is installed on the lower end of the cavity of bracket 1. The outer wall of the cork sleeve 34 is provided with two symmetrical mounting lugs. The two mounting lugs extend out of the second mounting hole of the bracket 1. The inner wall of the cork sleeve 34 is provided with three axial ribs distributed uniformly. The axial ends of the ribs may have sharp edges or the cross-sections thereof are V-shaped. The lower ends of the ribs are provided with a wedge. With wedges and sharp shape, the corks can be inserted into the three ribs, ensuring the cork to merely move along the cork sleeve 34 without rotating. The upper end of the cork sleeve 34 is provided with an annular counterbore on which a block 35 is installed. A through-hole used for avoiding the threaded drill 33 is provided in the middle of the block 35. The block 35 is used to block the cork, and it has a certain distance of travel. A second spring 37 is provided between the block 35 and the screw 32. The second spring 37 is in a compressed state, providing the screw 32 an upward axial force.

The clamping device 4 mainly comprises a first lever 41 and a second lever 42. The first lever 41 and second lever 42 are rotatably installed on the mounting lugs of the cork sleeve 34 respectively. The mounting lugs of the cork sleeve 34 are provided with a slot. The mounting lugs of the cork sleeve 34 are installed in the slot by a hinge pin. Furthermore, elastic rubber is provided between the slot and the hinge pin to ensure the hinge pin to move respect to the slot and stabilize the hinge pin in the slot. Therefore, it assures the first lever 41 and the second lever 42 can be adjustable with respect to the cork sleeve 34 with a certain distance, such that the clamping device 4 can clamp wine bottles with different sizes. The upper ends of the first lever 41 and the second lever 42 are provided with blocking plates opposed to each other. The blocking plates are inserted into the first evading apertures of the bracket 1. The blocking plates have sloping surfaces at its upper ends. Through the sloping surfaces, the blocking plates are in contact with the screw 32. When the screw 32 is moved downward in axial direction, the two blocking plates can be stretched, ensuring the lower ends of the first lever 41 and the second lever 42 to be drawn close to clamp the wine bottle. For better clamping the wine bottle, the lower ends of the first lever 41 and the second lever 42 are provided respectively with curved anti-slip covers 43 opposed to each other. The two curved anti-slip covers 43 can clamp the wine bottle tightly.

Each side of the lower end of the bracket 1 is provided with two auxiliary righting plate disposed between the first lever 41 and the second lever 43. The righting plate is used to right the wine bottle to ensure the wine opener to exit the wine bottle.

To automatically clamp the bottle and extract the cork, the electric wine opener further comprises an automatic control device 5. The automatic control device 5 comprises a start slider 51, a start switch 52, a reversal switch 53, a stop slider 54, a stop switch 55 and a controller (not shown in the figures). The start slider 51, which is of an annular structure, is installed on the opening of the lower end of the cork sleeve 34 via a spring 56. The start switch 52 is installed on the bracket 1 and arranged next to the start slider 51, so that the start switch 52 can be triggered after the start slider 51 is slid to the cork sleeve 34 and contacted with a contactor of the start switch 52. In order to guide the wine bottle and prevent the wine bottle from rotation, elastic soft rubber 57 with a cone-shaped inner hole is installed on the lower end of the start slider 51. The elastic soft rubber 57 is provided with an inside chamfer for guiding. The elastic soft rubber 57 can act as a stop.

The reversal switch 53 is installed on the bracket 1 and arranged next to the block 35 to allow the block 35 to be in contact with the contactor of the reversal switch 53 after the block 35 slides to the screw 32 so as to trigger the reversal switch 53. The stop slider 54 is movably installed on the bracket 1 via a spring. An end of the screw 32 next to the threaded drill 33 is provided with an annular bulge. The stop slider 54 passes through the bracket 1 and contacts the bulge of the screw 32. The stop switch 55 is installed on the bracket 1 and arranged next to the stop slider 54 to ensure the stop slider 54 to be in contact with the stop switch 55 after the stop slider 54 is separated from the bulge of the screw 32 so as to trigger the stop switch 55. The start switch 52, the reversal switch 53 and the stop switch 55 are electrically coupled to the controller. The controller is installed in the motor 2 and electrically coupled to the motor 22. In other embodiments, the stop slider 54 is in direct contact with the stop switch 55. By taking advantages of stretch and recovery possessed by the switch contactor of the stop switch, the stop slider 54 can be pushed achieve reciprocating movement.

The mechanism for clamping a bottle and pulling out a cork in the electric wine opener provided by the embodiment is shown below. Setting the wine opener to the bottleneck, slightly pushing the opener towards the bottom of the bottle to make the start slider 51 axially moves into position to trigger the start switch 52.

After a few seconds, the controller controls the motor 2 to rotate clockwise. The motor 22 drives the reducer 23, the gear chain 24 and the rotating shaft 21 to drive the screw 32 to rotate clockwise. When the screw 32 is rotated clockwise, the screw 32 is engaged with the sleeve 31 and is moved downward in axial direction under the elasticity of the compressed first spring 36.

The screw 32 starts to be moved downward for a certain distance where the threaded drill 33 is not drilled into the cork. The distance that is used for the screw 32 to separate the first lever 41 and the second lever 42. In this way, the wine bottle is clamped and held in a clamped state.

With further rotation and movement downward of the screw 32, the screw 32 starts to drill into the cork; and after drilling for a certain distance, the external thread of the screw 32 is moved to the lower end of the sleeve 31. Due to limitation by the bracket 1, the sleeve 31 cannot be moved axially.

At this time the screw 32 keeps rotating and drives the threaded drill 33 to rotate. The threaded drill 33 drills into the cork and extracts the cork simultaneous to pull the cork into the cork sleeve 34. The inner wall of the cork sleeve 34 is provided with three ribs distributed uniformly to prevent the cork from being rotated. Furthermore the screw 32 drives the threaded drill 33 to rotate, driving the cork to move upward in axial direction though the cork has been separated from the wine bottle. Eventually, the cork pushes the block 35 to move upward to trigger the reversal switch 53.

The controller controls the motor 22 to start rotating counterclockwise. Under the upward elasticity of the second spring 37, the screw 32 is engaged with the sleeve 31. During the counterclockwise rotation of the screw 32, the screw 32 is moved upward in axial direction until it reaches an original stop position. At that time, the clamping device loosens the wine bottle, while the screw 32 causes the stop slider 54 to trigger the stop switch 55, and the controller controls the motor 22 to stop rotating.

The auxiliary righting plates 44 can clamp the wine bottle to prevent the wine opener from falling down the wine bottle. After the electric wine opener is removed from the wine bottle, the start slider 51 can be returned to an initial position under the elasticity of the compressed start slider 51. After loosing the start switch 52, the controller will take a break for a few seconds and restart the motor to rotate for a certain time to extract the cork from the threaded drill 33 and the cork sleeve 34. Meanwhile the block 35 will be returned to its initial position under the elasticity of the second spring 37. Eventually, the entire automatic cork extraction process is completed.

The embodiment provides an electric wine opener. Because the bracket 1 is provided with the driving device 2, the cork extraction device 3 and the clamping device 4, the driving device 2 can drive the clamping device 3 to clamp and wine bottle and the cork extraction device 4 to extract the cork. Therefore, the electric wine opener can clamp the wine bottle automatically and extract the cork from the wine bottle automatically. The wine opener is easy to be operated, extracting the cork steadily and quickly.

Second Embodiment

Figure 6:
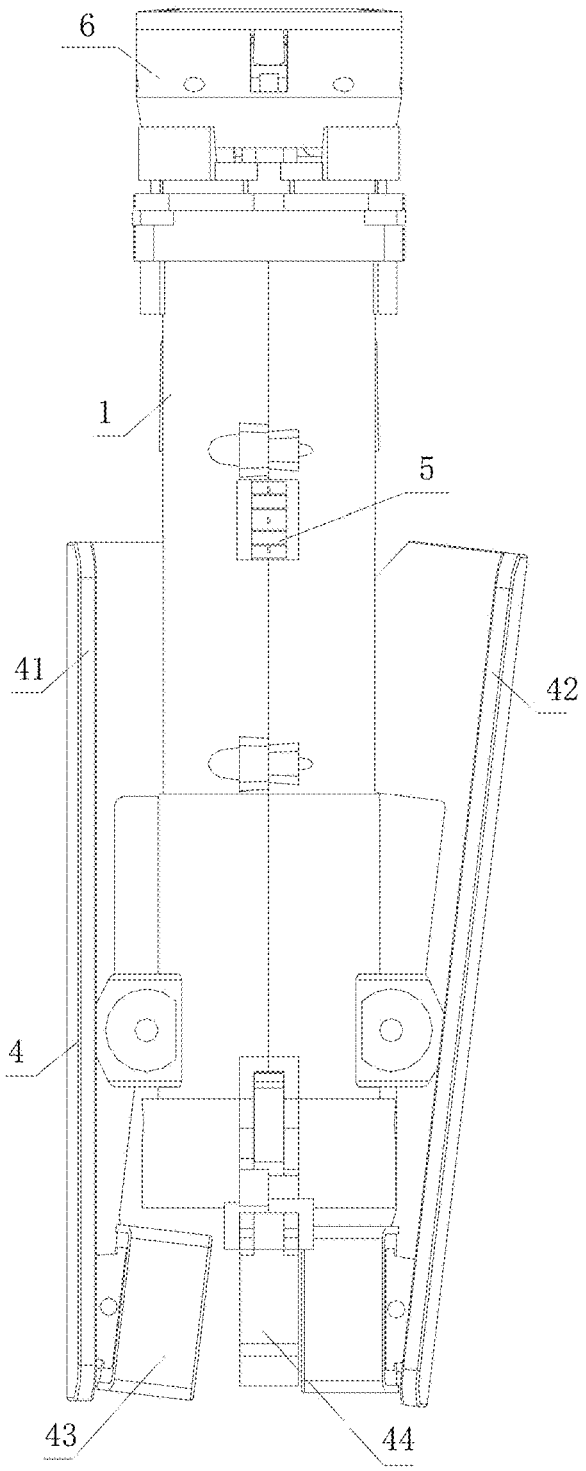
FIG. 6 is a front view of the electric wine opener in another embodiment.
Figure 7:
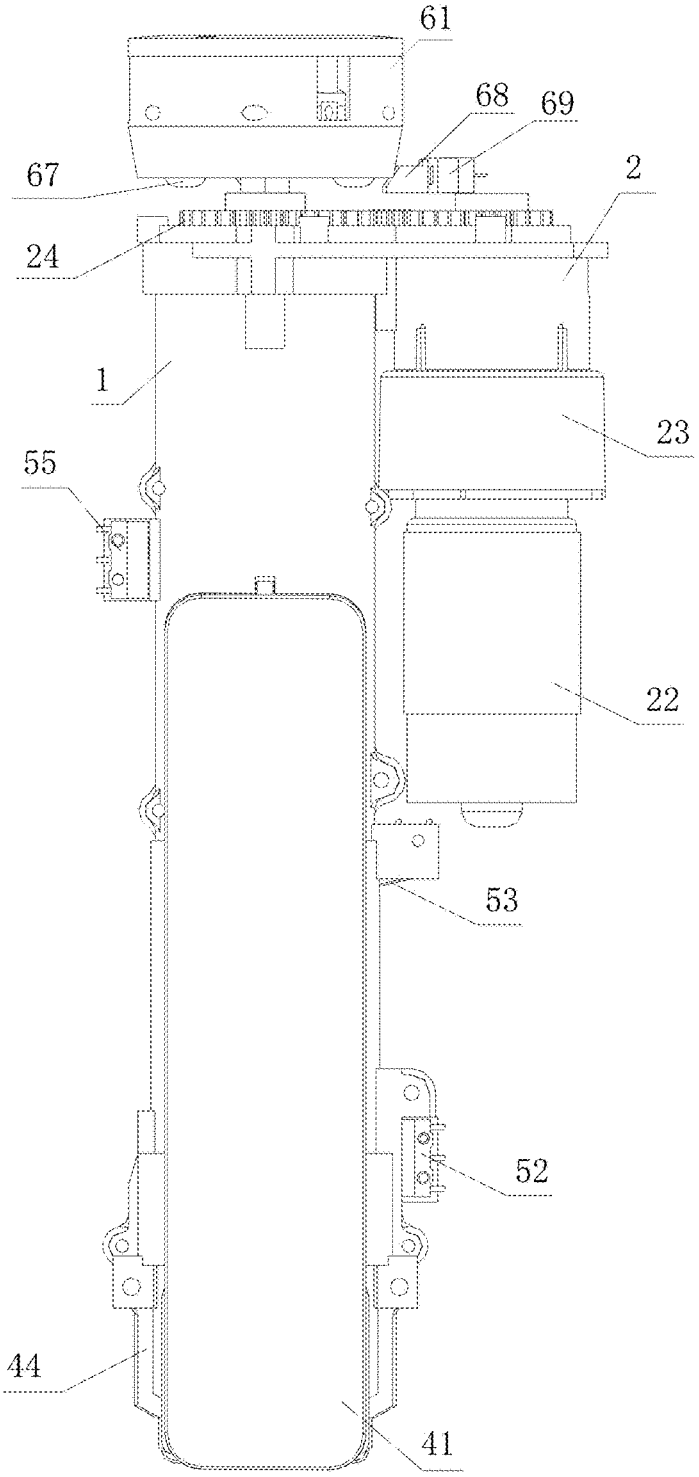
FIG. 7 is a side view of the electric wine opener in another embodiment.

As shown in FIGS. 6-7, on the basis of the first embodiment, this embodiment is further provided with a film cutting device 6 used to cut off the sealing film of the wine bottle.

Figure 8:
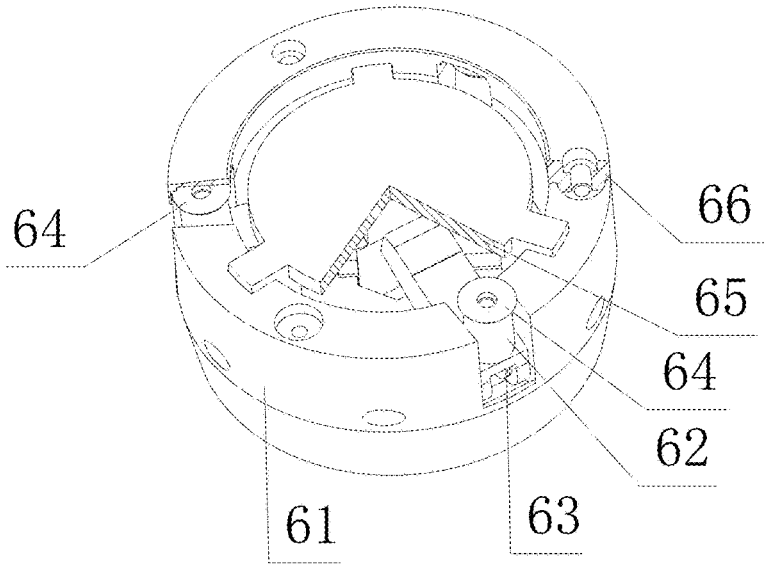
FIG. 8 is a part section view of a film cutting device of the electric wine opener in another embodiment.
Figure 9:
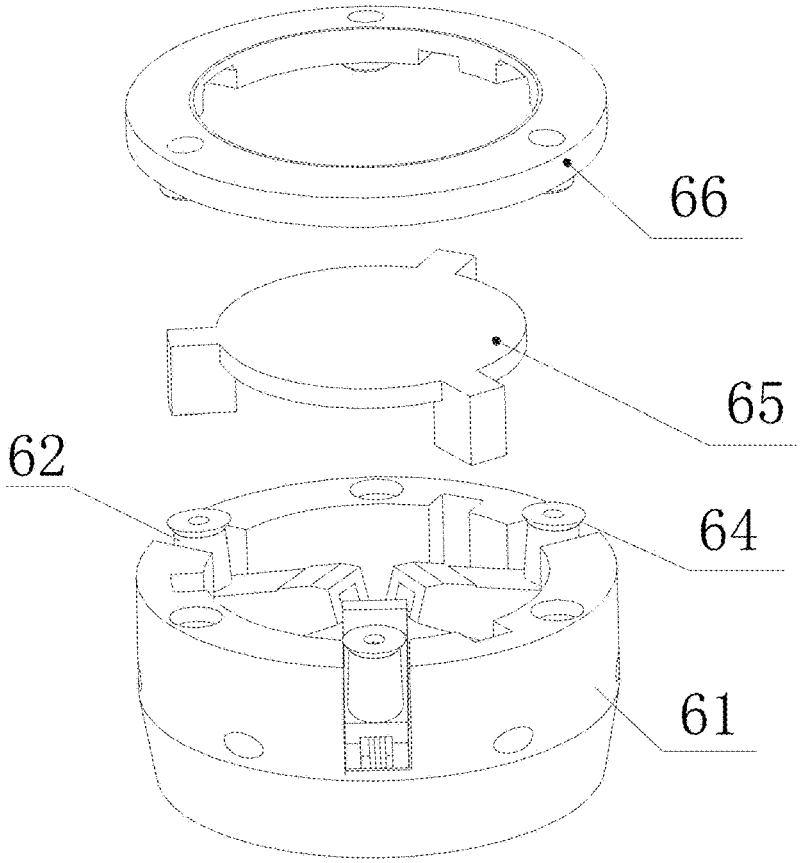
FIG. 9 is an exploded view of the film cutting device of the electric wine opener in another embodiment.

As shown in FIGS. 8-9, the film cutting device 6 is installed on the upper end of the bracket. The film cutting device 6 mainly comprises a rotating frame 61, a blade carrier 62, a torsion spring 63 and a blade 64. The upper end of the rotating frame 61 is provided with an open cavity to accommodate the bottleneck of the wine bottle. The lower end of the rotating frame 61 is provided with a hexagonal hole. The rotating frame 61 is fixed on the upper end of the rotating shaft 21 extending out the bracket 1 through the hexagonal hole.

The annular sidewall of the upper end of the rotating frame 61, which forms the open cavity, is provided with three slots distributed uniformly. Each slot is equipped with the blade carrier 62, the torsion spring 63 and the blade 64. One end of the blade carrier 62 is rotatably installed in the slot, and the bottom at this end of the blade carrier 62 is a rotatable arc-shaped structure. The other end of the blade carrier 62 tilts upward and extends into the open cavity of the rotating frame 61. The three blade carriers extend to the center respectively but not in contact with each other.

The blade 64 is installed on one end of the blade carrier 62 corresponding to the slot. The torsion spring 63 is installed in the slot. One end of the torsion spring 63 is in contact with the blade carrier 62 and the other end with the slot, so that the blade carrier 62 is stretched upwards by the torsion spring 63. At this moment, the blade 64 is totally accommodated in the slot. One of the three blades is necessary to be an edged blade, and the other two blades could have no edges.

In order to make it easier to push the three blade carriers 62, the film cutting device 6 is also provided with a balancing slider 65. The balancing slider 65 can be a circular disc-shaped structure. The circumference of the circular disc-shaped balancing slider 65 is provided with three bulges distributed uniformly. The rotating frame 61 is provided with three corresponding slots distributed uniformly. The balancing slider 65 is movably installed in the slots through the bulges. The rotating frame 61 is provided with a frame cover 66 to limit the balancing slider 65. When the balancing slider 65 is axially extruded, the tilted ends of the three blade carriers are extruded axially. Meanwhile the other ends of the blade carriers 62 are rotated and moved. At this moment the blade 64 is partially extended into the open cavity of the rotating frame 61 to cut off the sealing film of the wine bottle.

In order to achieve a cushion protection for the wine opener, the lower end of the rotating frame 61 is inlaid with three spring pins 67. The spring pins 67 are distributed uniformly on a circle and opposed to the bracket 1.

As shown in FIG. 7, the film cutting device 6 can also comprise a cutting slider 68 and a cutting switch 69. The cutting slider 68 is movably installed on the bracket 1 in axial direction. The cutting switch 69 is installed on the bracket 1 and arranged next to the cutting switch 68. The cutting switch 69 is electrically coupled to the controller. In other embodiments, the cutting slider is in contact with cutting switch 69 directly. By taking advantages of stretch and recovery possessed by the contactor of the cutting switch, the cutting slider 68 can be pushed to achieve reciprocating movement.

The electric wine opener provided in this embodiment has the ability to cut off the sealing film of the wine bottle. The mechanism of cutting is showed below. Setting the film cutting device 6 into the wine bottleneck, and pushing the film cutting device 6 towards the bottom of the bottle with heavy force, which, on the one hand, moves the rotating frame 61 in axial direction and to push the cutting slider 68 to move so as further to trigger the cutting switch 69. The motor 22 controls the motor 22 to rotate counterclockwise for a certain time (the rotation angle of the hexagonal shaft is larger than 360 degrees) and stop, so that the film cutting device 6 can be driven by the shaft 21 to rotate counterclockwise with an angle over 360 degrees. On the other hand, the balancing slider 65 is moved in axial direction, which drives the blade carrier 62 to rotate. Then the blade 64 installed on the blade carrier 62 can be moved toward axis and is against to the wall of the bottleneck. When the sealing film cutting device rotates, the blade 64 will cut off the sealing film.

The embodiment provides an electric wine opener. The electric wine opener is able to cut off the sealing film of the wine bottle and extract the cork. It can be used to open the wine bottle quickly at one time without other auxiliary tools. Furthermore, the electric wine opener can be operated by one hand. The electric wine opener is easy to be used and it can be used to open the wine bottle efficiently.

The present disclosure has been described above with reference to specific examples, which are merely provided for the purpose of understanding the present disclosure and are not intended to limit the present disclosure. It will be possible for a person skilled in the art to make several simple deductions, variations or substitutions based on the principle of the present disclosure.

What is claimed is:

1. An electric wine opener, comprising:

a bracket with a cylindrical structure, both ends of the bracket being provided with an opening, a sidewall of the bracket being provided with first evading apertures symmetrically arranged in the middle, and one end of the sidewall being provided with second evading apertures arranged symmetrically;

a drive device comprising a rotating shaft and a motor, the rotating shaft being provided with a polygonal cross-section, the shaft being rotatably installed on the bracket, the motor being installed on the bracket, and an output shaft of the motor being connected to the rotating shaft;

a cork extraction device comprising a sleeve, a screw, a threaded drill, a cork sleeve and a block, the sleeve with an internal thread at the middle being embedded in the bracket, the screw provided with a polygonal through-hole corresponding to the rotating shaft being fitted on the rotating shaft, the threaded drill accommodated in the bracket being fixed on one end of the screw, a first spring being arranged between the rotating shaft and the threaded drill in a state of compression, one end of the screw away from the threaded drill being provided with an external thread matched with the sleeve, the cork sleeve with two symmetrical mounting lugs being installed in the bracket, the mounting lugs projecting from the second evading apertures of the bracket, one end of the cork sleeve close to the screw being provided with an annular counterbore, the block being movably installed on the counterbore, a second spring being arranged between the block and the bracket in a state of compression, a through-hole being provided in the middle of the block for avoiding the threaded drill, the sleeve and the cork sleeve being disposed on both ends of the bracket respectively, and the inner wall of the cork sleeve being provided with an axial rib; and a clamping device comprising a first lever and a second lever, the first lever and second lever being symmetrically and rotatably installed on the mounting lugs of the cork sleeve, the same ends of the first lever and the second lever being respectively provided with blocking plates opposed to each other, the blocking plates being inserted into the first evading apertures of the bracket, the blocking plate being in contact with the screw via a sloping surface, and the other ends of the first lever and the second lever being respectively provided with curved anti-slip covers opposed to each other.

2. The electric wine opener of claim 1, wherein the electric wine opener further comprises an automatic control device which comprises a start slider, a start switch, a reversal switch, a stop slider, a stop switch and a controller;

the start slider having an annular structure is installed on an open end of the cork sleeve via a spring, the start switch is installed on the bracket, the start switch is arranged close to the start slider to allow the start slider to be in contact with a contactor of the start switch after the start slider is slid to the cork sleeve to trigger the start switch;

the reversal switch is installed on the bracket, the reversal switch is arranged close to the block to allow the block to be in contact with a contractor of reversal switch after the block is slid to the screw to trigger the reversal switch;

the stop slider is movably installed on the bracket via a spring, one end of the screw close to the threaded drill is provided with an annular bulge, the stop slider is in contact with the bulge of the screw by moving through the bracket, the stop switch is installed on the bracket, the stop switch is arranged close to the stop slider to allow the stop slider to be in contact with the stop switch after the stop slider is separated from the bulge of the screw to trigger the stop switch; and the start switch, the reversal switch and the stop switch are connected to the controller respectively, the controller being electrically coupled to the motor.

3. The electric wine opener of claim 2, wherein the driving device comprises a reducer and a gear train, the reducer is installed on the bracket, the output shaft of the motor is connected to the reducer, and the rotating shaft is connected to an output shaft of the reducer via the gear train.

4. The electric wine opener of claim 3, wherein the mounting lugs of the cork sleeve is provided with slots, the first lever and second lever are rotatably installed on the slots via hinge pins respectively, and elastic rubber is filled between the slot and the hinge pin.

5. The electric wine opener of claim 4, wherein elastic soft rubber with a cone-shaped inner hole is embedded in an inner hole of the start slider.

6. The electric wine opener of claim 4, wherein one end of the bracket away from the motor is provided with two auxiliary righting plates disposed between the first lever and the second lever.

7. The electric wine opener of claim 1, wherein the electric wine opener further comprises a film cutting device comprising a rotating frame, a blade carrier, a torsion spring and a blade; the rotating frame is fixed on an end of the rotating shaft extending out the bracket, the rotating frame is provided with an open cavity used for accommodating a bottleneck, the sidewall of the open cavity is provided with a slot; one end of the blade carrier is rotatably installed on the slot of the rotating frame, and the other end of the blade carrier is extended into the open cavity of the rotating frame; the torsion spring is installed between the blade carrier and the rotating frame, one end of the torsion spring is in contact with the blade carrier, and the other end of torsion spring is in contact with the rotating frame; and the blade is installed on one end of the blade barrier positioned on the slot, when one end of the blade is axially moved to the rotating shaft, the other end of the blade is raised, causing part of the blade extend into the open cavity of the rotating frame.

8. The electric wine opener of claim 7, wherein the electric wine opener further comprises a cutting slider and a cutting switch; the cutting slider is movably installed on the bracket; the cutting switch is installed on the bracket and arranged close to the cutting slider, and the cutting switch is electrically connected with the controller.

9. The electric wine opener of claim 8, wherein the electric wine opener further comprises a balancing slider covered on three blade carriers, and axially and movably installed on the rotating frame.

10. The electric wine opener of claim 9, wherein three spring pins uniformly distributed in a circle are embedded on a surface of the rotating frame opposed to the bracket.

* * * * *